US007837313B2

(12) United States Patent
Gold et al.

(10) Patent No.: US 7,837,313 B2
(45) Date of Patent: Nov. 23, 2010

(54) METHOD OF RECONFIGURING INK STICKS

(75) Inventors: Christopher Ryan Gold, Tigard, OR (US); Barry D. Reeves, Lake Oswego, OR (US); William Loren Emery, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 50 days.

(21) Appl. No.: 12/139,636

(22) Filed: Jun. 16, 2008

(65) Prior Publication Data

US 2009/0207221 A1 Aug. 20, 2009

Related U.S. Application Data

(62) Division of application No. 12/031,964, filed on Feb. 15, 2008.

(51) Int. Cl.
*B41J 2/175* (2006.01)

(52) U.S. Cl. ..... 347/88; 347/99

(58) Field of Classification Search ..... 347/88, 347/99

See application file for complete search history.

(56) References Cited

U.S. PATENT DOCUMENTS

| | | | | |
|---|---|---|---|---|
| 3,722,240 | A * | 3/1973 | Spain et al. | 70/494 |
| 6,761,444 | B2 | 7/2004 | Jones et al. | |
| 6,857,732 | B2 | 2/2005 | Jones et al. | |
| D505,973 | S | 6/2005 | Jones et al. | |
| 6,986,570 | B2 | 1/2006 | Jones et al. | |
| 2003/0202056 | A1 | 10/2003 | Jones et al. | |
| 2003/0202071 | A1 | 10/2003 | Jones et al. | |
| 2003/0202074 | A1 * | 10/2003 | Jones | 347/99 |
| 2003/0202076 | A1 | 10/2003 | Jones et al. | |
| 2008/0122913 | A1 * | 5/2008 | Jones et al. | 347/99 |

FOREIGN PATENT DOCUMENTS

| | | |
|---|---|---|
| EP | 1359014 | 11/2003 |
| EP | 1359023 | 11/2003 |
| EP | 1359024 | 11/2003 |
| EP | 1731309 | 12/2006 |

OTHER PUBLICATIONS

European Search Report, European Patent Office, Munich, DE, dated May 6, 2009 (7 pages).

Non-Final Office Action for U.S. Appl. No. 12/031,964, Mailed Oct. 2, 2009, United States Patent and Trademark Office (14 pages).

(Continued)

*Primary Examiner*—Matthew Luu
*Assistant Examiner*—Rut Patel
(74) *Attorney, Agent, or Firm*—Maginot, Moore & Beck LLP

(57) ABSTRACT

A solid ink stick comprises an ink stick body formed of a phase change ink material. The ink stick body has a plurality of exterior surfaces arranged in a first ink stick body configuration. At least one simulation surface is formed in the ink stick body. The at least one simulation surface simulates a second ink stick body configuration. The simulation surface is functionally significant though may not extend around the full perimeter of the ink stick body or to the full plurality of exterior surfaces.

15 Claims, 6 Drawing Sheets

OTHER PUBLICATIONS

Amendment in Response to Non-Final Office Action for U.S. Appl. No. 12/031,964, submitted Jan. 4, 2010 (14 pages).

Final Office Action for U.S. Appl. No. 12/031,964, Mailed Mar. 16, 2010, United States Patent and Trademark Office (13 pages).

Amendment accompanying a Request for Continued Examination for U.S. Appl. No. 12/031,964, submitted May 17, 2010 (10 pages).

Second Non-Final Office Action for U.S. Appl. No. 12/031,964, Mailed Jun. 4, 2010, United States Patent and Trademark Office (14 pages).

* cited by examiner

METHOD OF RECONFIGURING INK STICKS

CROSS-REFERENCE TO RELATED APPLICATIONS

This application is a divisional application of U.S. application Ser. No. 12/031,964, filed Feb. 15, 2008, by Gold et al., and entitled "Solid Ink Stick with Witness Mark," the contents of which is hereby expressly incorporated herein by reference in its entirety.

TECHNICAL FIELD

This disclosure relates generally to phase change ink jet printers and the solid ink sticks used in such ink jet printers.

BACKGROUND

Solid ink or phase change ink imaging devices, hereafter called solid ink printers, encompass various imaging devices, such as printers and multi-function devices. These printers offer many advantages over other types of image generating devices, such as laser and aqueous inkjet imaging devices. Solid ink or phase change ink printers conventionally receive ink in a solid form, generally either as pellets or as ink sticks. A color printer typically uses four colors of ink (yellow, cyan, magenta, and black).

The solid ink pellets or ink sticks, hereafter referred to as ink, sticks, or ink sticks, are delivered to a melting device, which is typically coupled to an ink loader, for conversion of the solid ink to a liquid. A typical ink loader includes multiple feed channels, one for each color of ink used in the imaging device. Each channel has an insertion opening in which ink sticks of a particular color are placed and then either gravity fed or urged by a conveyor or a spring-loaded pusher along the feed channel. Each feed channel directs the solid ink within the channel towards a melting device located at the end of the channel. Each melting device receives solid ink from the feed channel to which the melting device is connected and heats the solid ink impinging on it to convert the solid ink into liquid ink that is delivered to a print head for jetting onto a recording medium or intermediate transfer surface.

Each feed channel insertion opening may be covered by a key plate having a keyed opening. The keyed openings help ensure a printer user places ink sticks of the correct color in a feed channel. To accomplish this goal, each keyed opening has a unique shape. The ink sticks of the color corresponding to a particular feed channel have a shape corresponding to the shape of the keyed opening. The keyed openings and corresponding ink stick shapes exclude from each ink feed channel ink sticks of all colors except the ink sticks of the proper color for the feed channel. Unique keying shapes for other factors are also employed in keyed openings to exclude from a feed channel ink sticks that are formulated or intended for other printer models.

Advances in printing technology as well as changing needs of customers may necessitate changes to printhead and ink loader configurations, ink stick keying and authentication methodology, etc. Ink sticks that have been shaped coded or keyed for use with a particular printing platform or ink loader configuration that has been modified or discontinued may not be appropriately configured for use with other printers or ink loaders even if the ink sticks are otherwise compatible with those printers or ink loaders.

SUMMARY

A solid ink stick has been developed that is configured to simulate other ink stick configurations. The solid ink stick comprises an ink stick body formed of a phase change ink material. The ink stick body has a plurality of exterior surfaces arranged in a first ink stick body configuration. The ink stick includes at least one simulation surface formed in the ink stick body. The at least one simulation surface is configured to simulate a second ink stick body configuration. The simulation surface is functionally significant though may not extend around the full perimeter of the ink stick body or to the full plurality of exterior surfaces.

In another embodiment, a method of modifying an ink stick has been developed that enables an ink stick having a first configuration to be modified to form a second ink stick body configuration. The method comprises selecting an ink stick formed of a phase change ink material, the ink stick including an exterior surface having a first configuration; and modifying the exterior surface of the ink stick to form a second configuration that is different than the first configuration.

DETAILED DESCRIPTION OF THE PREFERRED EMBODIMENT

Figure 1:
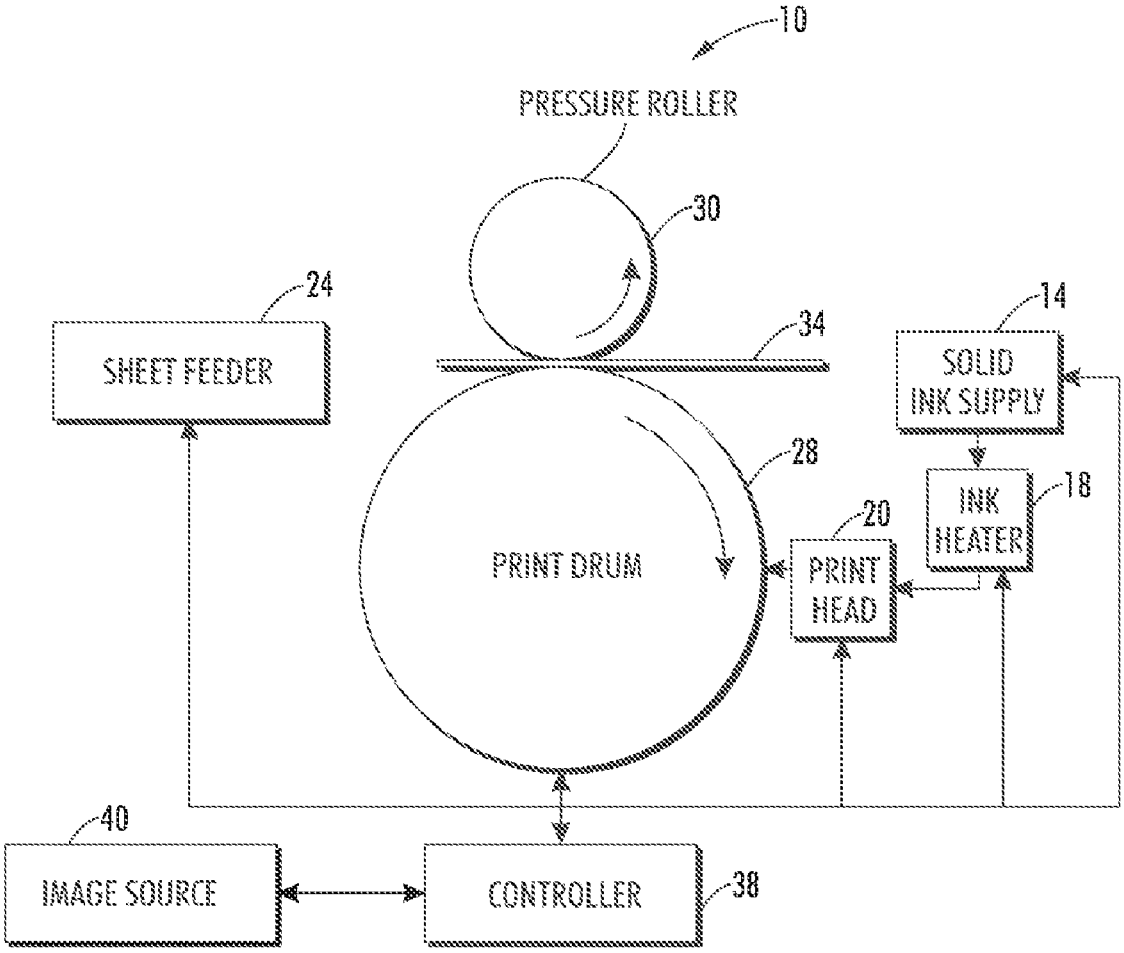
FIG. 1 PRIOR ART
FIG. 1 is a block diagram of a phase change ink imaging device.

For a general understanding of the present embodiments, reference is made to the drawings. In the drawings, like reference numerals have been used throughout to designate like elements. As used herein, the term "printer" refers, to reproduction devices in general, such as printers, facsimile machines, copiers, and related multi-function products; and the term "print job" refers, for example, to information including the electronic item or items to be reproduced. References to ink delivery or transfer from an ink cartridge or housing to a printhead are intended to encompass the range of melters, intermediate connections, tubes, manifolds and/or other components and/or functions that may be involved in a printing system but are not immediately significant to the present disclosure.

Referring now to FIG. 1, there is illustrated a block diagram of an embodiment of a phase change ink imaging device 10. The imaging device 10 has an ink supply 14 which receives and stages solid ink sticks. An ink melt unit 18 heats the ink stick above its melting point to produce liquefied ink. The melted ink is supplied to a printhead assembly 20 by gravity, pump action, or both. The imaging device 10 may be a direct printing device or an offset printing device. In a direct printing device, the ink may be emitted by the print head 20 directly onto the surface of a recording medium.

The embodiment of FIG. 1 shows an indirect, or offset, printing device. In offset printers, the ink is emitted onto a transfer surface 28 that is shown in the form of a drum, but could be in the form of a supported endless belt. To facilitate the image transfer process, a pressure roller 30 presses the media 34 against the ink on the drum 28 to transfer the ink from the drum 28 to the media 34.

Operation and control of the various subsystems, components, and functions of the machine or printer 10 are performed with the aid of a controller 38. The controller 38, for example, may be a micro-controller having a central processor unit (CPU), electronic storage, and a display or user interface (UI). The controller reads, captures, prepares and manages the image data flow between image sources 40, such as a scanner or computer, and imaging systems, such as the printhead assembly 20. The controller 38 is the main multitasking processor for operating and controlling many or all of the other machine subsystems and functions, including the machine's printing operations, and, thus, includes the necessary hardware, software, etc. for controlling these various systems.

Figure 2:
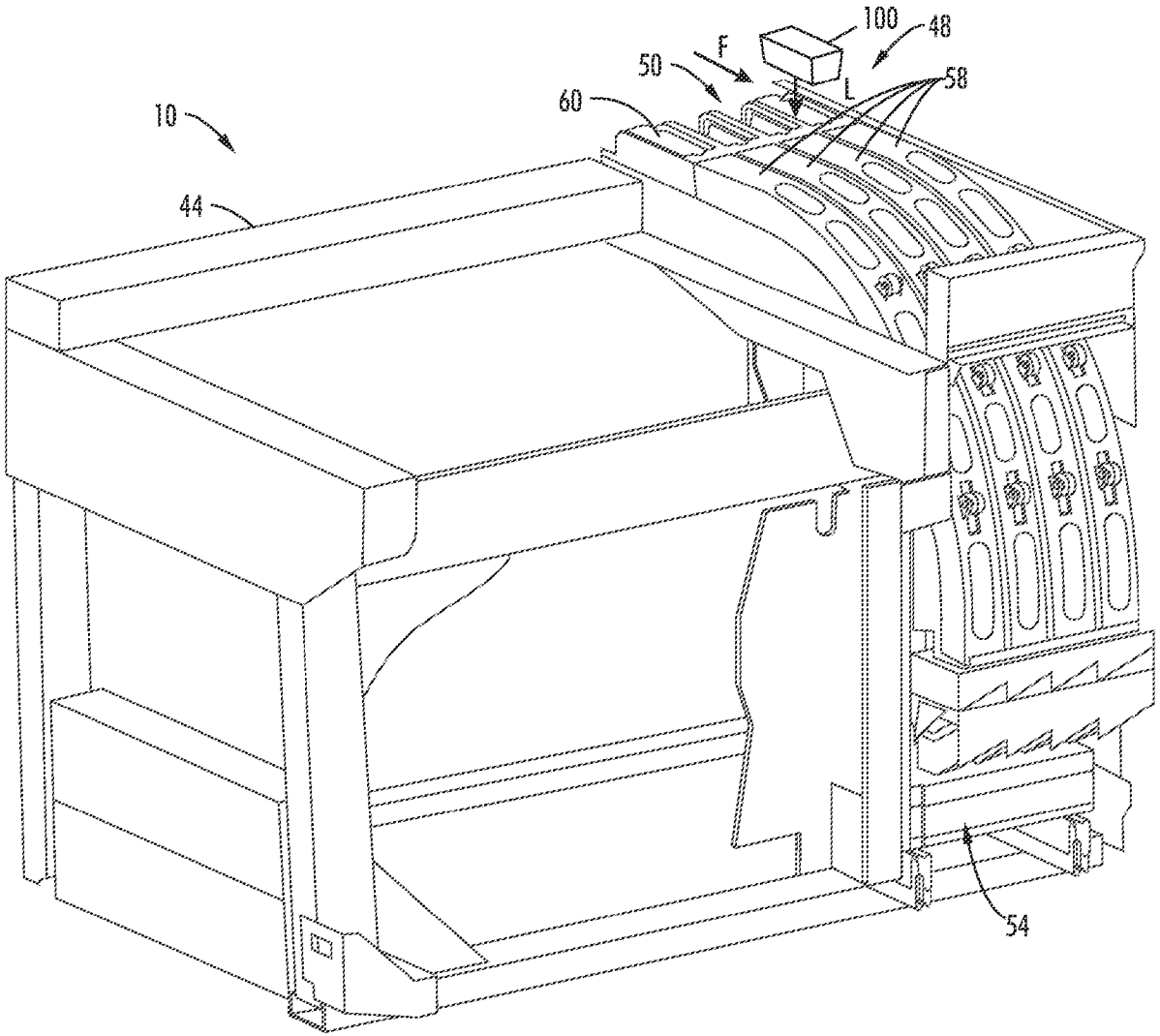
FIG. 2 is an enlarged partial top perspective view of an embodiment of an incomplete phase change ink imaging device with an ink loader.

Referring now to FIG. 2, the device 10 includes a frame 44 to which the operating systems and components are directly or indirectly mounted. A solid ink delivery system 48 advances ink sticks from loading station 50 to a melting station 54. The loading station includes keyed openings 60. Each keyed opening 60 limits access to one of the individual feed channels 58 of the ink delivery system. The keyed openings 60 are configured to accept only those ink sticks having key elements that comport with the key structures of the openings 60. Thus, the keyed openings 60 help limit the ink sticks inserted into a channel to a particular configuration such as color, ink formulation, etc. The ink delivery system 48 includes a plurality of channels, or chutes, 58 for transporting ink sticks from the loading station 60 to the melting station 54. A separate channel 58 is utilized for each of the four colors: namely cyan, magenta, black and yellow. The melting station 54 is configured to melt the solid ink sticks and supply the liquid ink to a printhead system (not shown).

In the embodiment of FIG. 2, the loading station receives ink sticks inserted through the keyed openings 60 in an insertion direction L. The feed channels are configured to transport ink sticks in a feed direction F from the loading station to the melting station. In the embodiment of FIG. 2, the insertion and feed directions L, F are different. For example, ink sticks may be inserted in the insertion direction L and then moved along the feed channel in the feed direction F. In an alternative embodiment, the feed channels and keyed openings may be oriented such that the insertion and feed directions L, F are substantially parallel.

Figure 3:
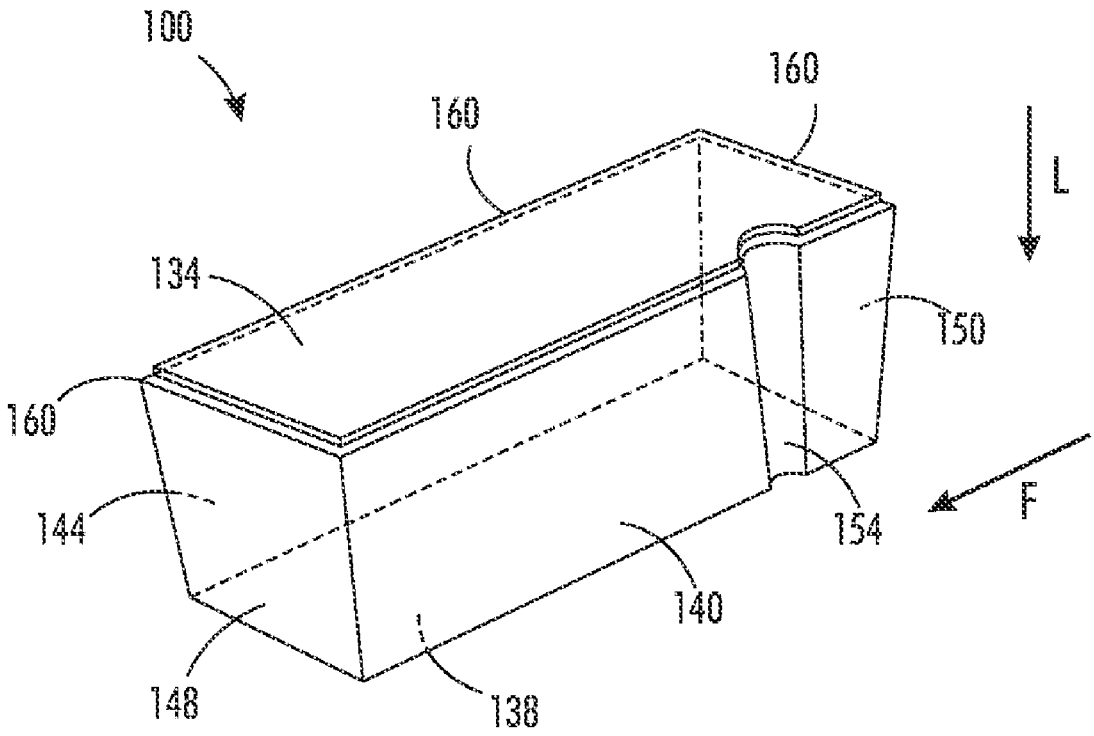
FIG. 3 is a perspective view of one embodiment of a solid ink stick that includes a witness mark.

An ink stick may take many forms. One exemplary solid ink stick 100 for use in the ink delivery system is illustrated in FIG. 3. The ink stick has a bottom surface 138 and a top surface 134. The particular bottom surface 138 and top surface 134 illustrated are substantially parallel one another, although they can take on other contours and relative relationships. Moreover, the surfaces of the ink stick body need not be flat, nor need they be parallel or perpendicular one another. The ink stick body also has a plurality of side extremities, such as lateral side surfaces 140, 144 and end surfaces 148, 150. The side surfaces 140 and 144 are substantially parallel one another, and are substantially perpendicular to the top and bottom surfaces 134, 138. The end surfaces 148, 150 are also basically substantially parallel one another, and substantially perpendicular to the top and bottom surfaces, and to the lateral side surfaces. One of the end surfaces 148 is a leading end surface, and the other end surface 150 is a trailing end surface. The ink stick body may be formed by pour molding, injection molding, compression molding, or other known techniques.

Ink sticks may include a number of features that aid in correct loading, guidance, sensing, and support of the ink stick when used. These functionally significant features may comprise contours such as protrusions and/or indentations that are located in different positions on an ink stick for interacting with key elements, guides, supports, sensors, etc. located in complementary positions in the ink delivery system. Sensing features may have multiple functions, such as interacting with one or more sensors and/or guiding, supporting, admitting and restricting insertion or feed.

Loading features may be categorized as insertion features or feeding features. Insertion features such as exclusionary keying elements and orientation elements are configured to facilitate correct insertion of ink sticks into the loading station and, as such, are substantially aligned with the insertion direction L of the loading station. As an example, the ink stick of FIG. 3 includes an insertion keying feature 154. The insertion keying feature is configured to interact with the keyed openings 60 of the loading station 50 to admit or restrict insertion of the ink sticks through the insertion opening 60 of the solid ink delivery system. In the ink stick embodiment of FIG. 3, the key element 154 is a vertical recess or notch formed in side surface 140 of the ink stick body substantially parallel to the insertion direction L of the loading station. The corresponding complementary key (not shown) on the perimeter of the keyed opening 60 is a complementary protrusion into the opening 60. Visual markings, such as numbers, letters, logo, arrows and so forth, may also be present on a surface of the stick such that they draw attention to that surface and therefore serve to aid one in orienting the stick as it is viewed or held in the hand for identification or as it is loaded through an insertion opening. Visual markings may be any one or a combination of inset, protruding, laser or alternatively etched, imprinted or otherwise formed marks. The surface having such visual markings is usually, but not necessarily, considered the top surface of the ink stick. The surface considered to be the top surface may actually be oriented at any angular relationship relative to nominal horizontal, both as viewed exclusive of use or in relationship to an imaging product and as inserted into an ink loader. The terms top and bottom encompass the case where one would otherwise be inclined to refer to these surfaces as front and back or ends, if the remaining surfaces are considered sides.

Although not depicted, the ink stick may include feeding features, such as alignment and guide elements, to aid in aligning and guiding ink sticks as they are moved along the feed channels to reduce the possibility of ink stick jams in the feed channel and to promote optimum engagement of the ink sticks with an ink melter in the ink melt assembly. Feed features may include configurations that permit or restrict the feed function of an inserted stick. Feeding features, therefore, may be substantially aligned with the feed direction F of the ink delivery system in order to interact with ink stick guides and/or supports in the ink delivery system. An ink stick may have any suitable number and/or placement of loading (i.e. insertion and/or feeding) features. Some of these features may be substantially perpendicular to one another, substantially aligned or have any other relationship.

Each color for a printer may have a unique arrangement of one or more key elements in the outer perimeter of the ink stick to form a unique cross-sectional shape for that particular color ink stick. The combination of the keyed openings in the key plate and the keyed shapes of the ink sticks insure that only ink sticks of the proper color are inserted into each feed channel. A set of ink sticks is formed of an ink stick of each color, with a unique key and/or sensing feature arrangement for ink sticks of each color. Insertion keying may also be used to differentiate ink sticks intended for different models of printers. One type of insertion key may be placed in all the keyed openings of feed channels of a particular model printer. Ink sticks intended for that model printer contain a corresponding insertion key element. An insertion key of a different size, shape, or position may be placed in the keyed openings of the feed channels of different model printers As mentioned above, ink sticks that are otherwise similarly or even identically formulated may be provided with different keying features or contours that correspond to different marketing programs, price points, etc. For example, referring to FIG. 4, there is shown a pair of ink sticks 100A, 100B. For the sake of this discussion, the ink stick 100A and ink stick 100B may be considered to have substantially similar, or even identical, formulations. Accordingly, the ink material of each of the sticks 100A and 100B may be compatible with the same types of printers. The ink stick 100A, however, is manufactured for sale, distribution and/or use as part of a first marketing program and/or to be sold at a first price point. The ink stick 100B is manufactured for sale, distribution and/or use as part of a second marketing program and/or to be sold at a second price point. Accordingly, the ink sticks 100A and 100B each include a key element 168A, 168B or contour at different positions on the respective ink sticks that corresponds to the first and second marketing programs, respectively. Printer 170A corresponding to the first marketing program is provided with an insertion opening 174A that has a complementarily shaped and positioned contour 178A that allows the insertion of ink stick 100A therethrough while excluding ink sticks that do not have the appropriate contours or shapes, such as ink stick 100B. Similarly, printer 170B corresponding to the second marketing program is provided with an insertion opening 174B that has a complementarily shaped and positioned contour 178B that allows the insertion of ink stick 100B therethrough while excluding ink sticks that do not have the appropriate contours or shapes, such as ink stick 100B. Other means of differentiation between sticks may be employed, such as features exclusive to sensing, that eliminate the need for physical loading feature changes or significant size difference, such as between sticks 100A and 100B in the reference example.

Ink loader arrangements as well as identification and authentication requirements for ink sticks may change. The ink sticks that were shape coded for use with a particular ink loader may not be shaped appropriately for use with other printing platforms or ink loaders even if the ink sticks are otherwise compatible with those printing platforms. Accordingly, a method has been developed in which ink sticks may be modified to include sensing features, loading features or feeding features that were not previously included in the ink stick. The method includes the incorporation of a simulation surface or contour into an ink stick body. As used herein, a simulation surface is a surface that is formed, applied, added to, or placed on an ink stick body that allows the ink stick body having a first configuration to simulate a second ink stick body configuration and therefore the function or functions of that configuration.

Figure 4:
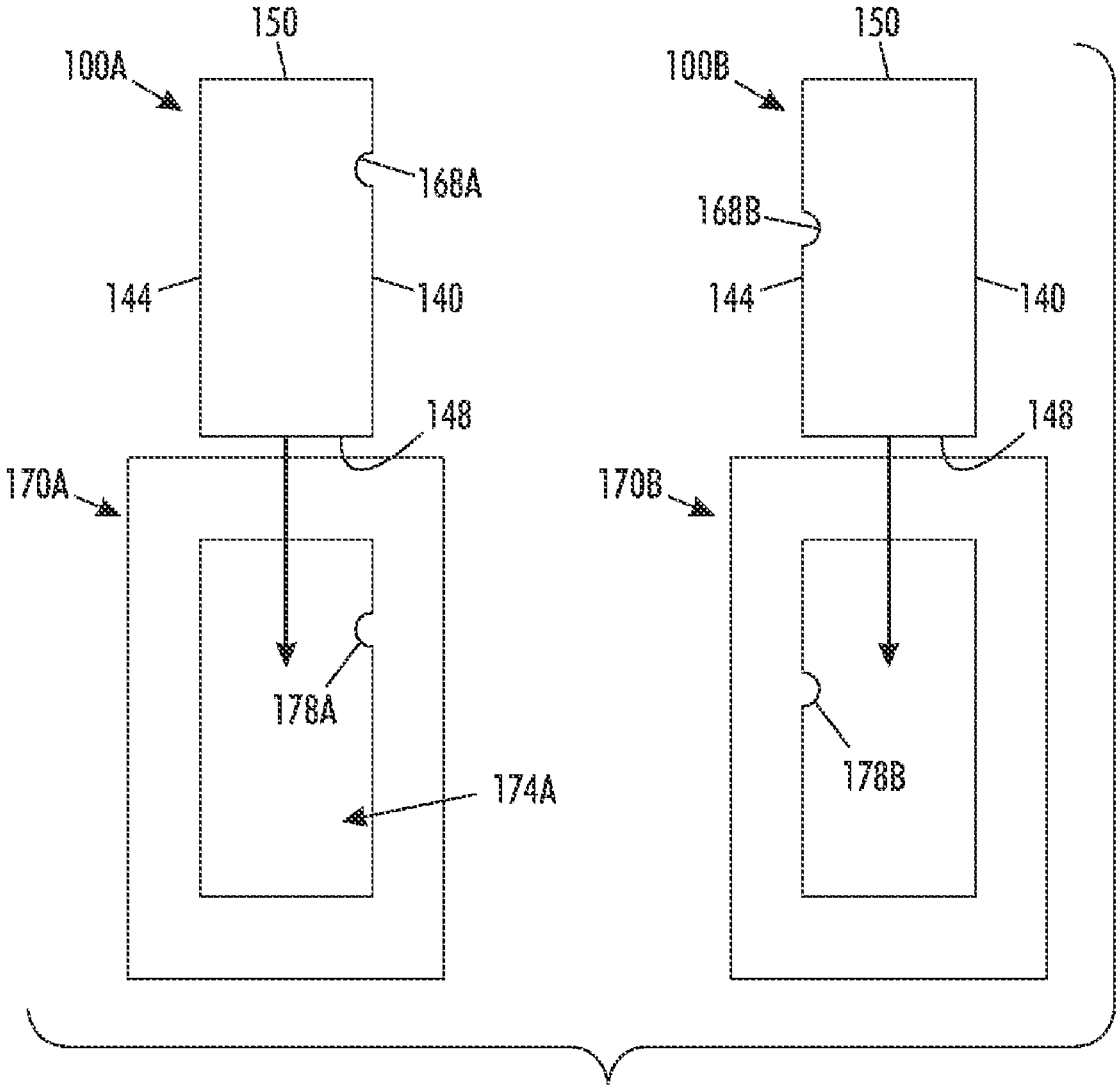
FIG. 4 is a top perspective view of a pair of ink sticks with corresponding insertion openings.
Figure 5:
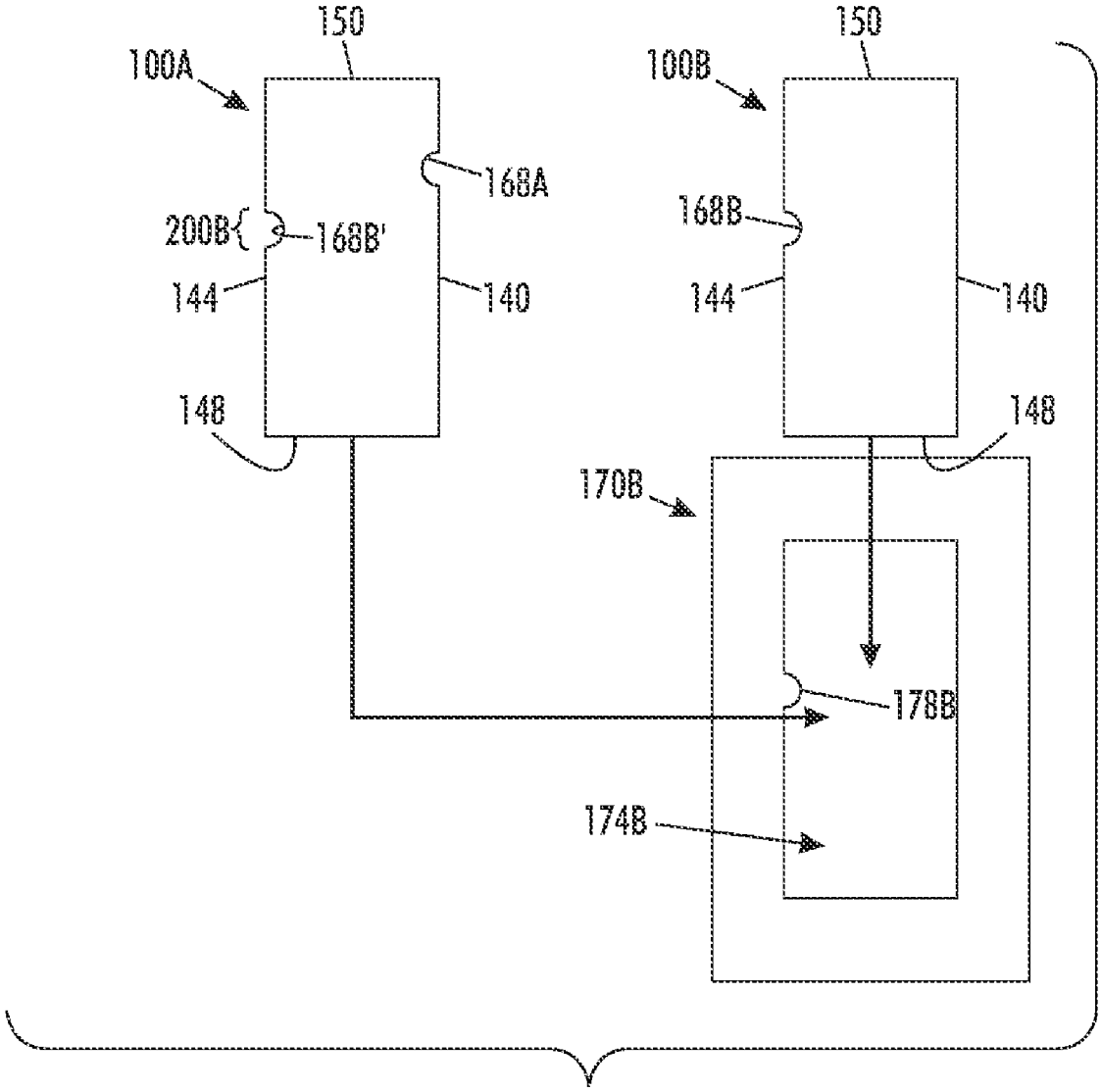
FIG. 5 is a top perspective view of the ink sticks of FIG. 4 in which one of the ink sticks has been modified to be compatible with the opening for the other ink stick.

For example, referring now to FIG. 5, there is depicted the ink stick 100A of FIG. 4. The ink stick 100A has been modified to include the simulation surface 200B. The simulation surface 200B of ink stick 100A is designed to simulate the key contour 168B of ink stick 100B of FIG. 4. Accordingly, the simulation surface 200B includes a recess key contour 168B' that is designed to correspond to the contour 168B of ink stick 100B. As seen in FIG. 5, the simulation surface 200B of the ink stick 100A adjusts the shape of the ink stick 100A to allow the ink stick 100A to be inserted through the shaped opening 174B of the printer 170B.

As used herein, a simulation surface comprises all or a portion of the exterior surface of an ink stick that may be configured to simulate substantially any type of sensor or loading feature, contour or marking of any ink stick body configuration. For example, a simulation surface may be configured to simulate insertion contours such as recesses and/or protrusions, feeding contours, visual markings, sensor features, etc of any ink stick body configuration. Forming a simulation surface that includes recessed and/or protruding contours may require the removal or addition of ink material in desired places on the ink stick body. A simulation surface, however, may be configured to simulate surfaces other than recessed or protruding contours and visual markings. For example, a simulation surface may be incorporated into an ink stick to essentially "remove" a contour from an ink stick. In this case, protruding contours may be removed by removing the corresponding ink material; recessed contours may be removed by "filling in" the recessed areas with appropriate ink material. Simulation surfaces may be formed on an ink stick body in any suitable manner. For example, in one embodiment, simulation surfaces may be formed by milling, cutting, compression molding, melting and reforming, etc.

In order to provide visual indication of whether an ink stick has been reconfigured from a first ink stick body configuration to a second ink stick body configuration using one or more simulation surfaces, ink sticks may be formed with witness marks. For example, the ink stick of FIG. 3 includes a witness mark 160. A witness mark 160 comprises a line, groove, step, notch, bevel, inset, protrusion or other contrasting feature that extends along at least a portion of one or more surfaces, edges, or perimeter segments of the ink stick. Witness marks may be formed so that they follow the contour of key features that have been included in the ink stick. For example, as shown in FIG. 3, the witness mark follows the interior contour of the key element 154 of the ink stick. In addition, witness marks may be formed in positions that correspond to potential or possible key element locations. Possible key element locations on the ink stick comprise areas on the surface of the ink stick that are likely to be modified in order to add, remove, or otherwise reconfigure the keying configuration of the ink stick. The possible key element locations of the ink stick include an orientation at which the possible key elements may be placed. For example, any of the side surfaces 140, 144, 148, 150 of the ink stick of FIG. 3 may be modified to add additional insertion key elements that extend along the side surface between the top surface and the bottom surface of the ink stick substantially parallel to the insertion direction L.

Figure 6:
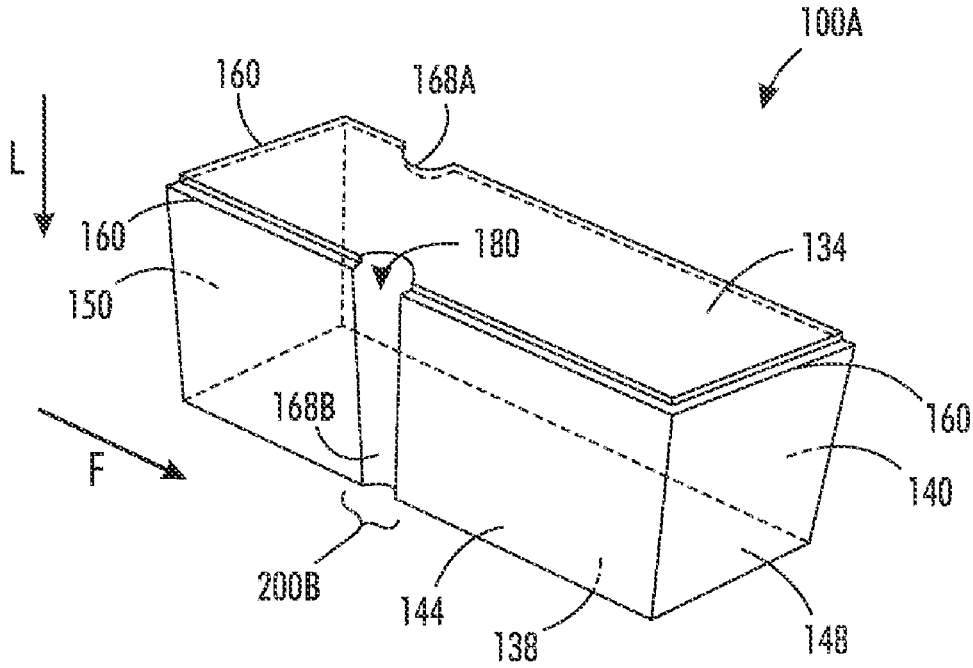
FIG. 6 is a perspective view of one embodiment of a solid ink stick that includes a witness mark and a simulation surface.
Figure 7:
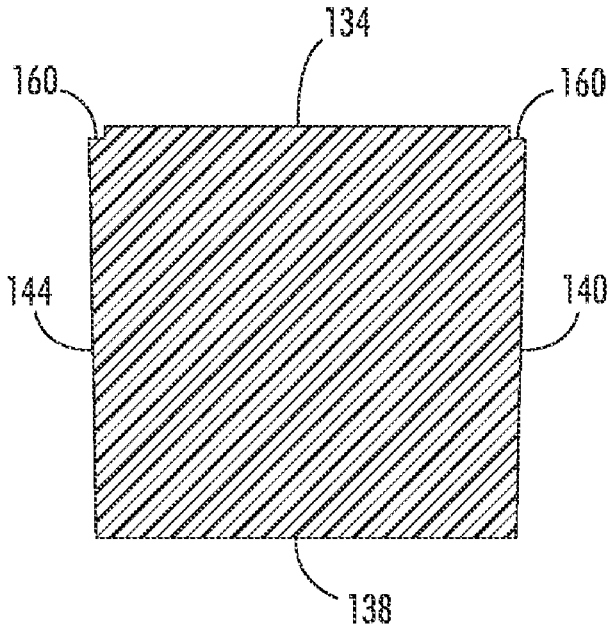
FIG. 7 is cross-sectional elevational view of an ink stick including a witness mark in the form of a step down height transition.

The witness mark of FIG. 3 extends around the edge or perimeter of the ink stick in a direction that is transverse to the insertion direction L of the ink stick. The witness mark is substantially continuous along the entire perimeter, however, in alternative embodiments, witness marks may be extend along some but not all of the perimeter segments. Witness marks may be positioned to extend along any portion of substantially any surface of the ink stick including along an edge of a surface or any place between the edges of a surface. In the embodiment of FIG. 3, the witness mark extends along the edge or perimeter of the ink stick where the top surface and the respective side surfaces meet. In one embodiment, the witness mark 160 comprises a step down height transition formed along the perimeter segments of the ink stick as shown in FIGS. 3 and 6. Other features that are capable of providing a visual indication of ink stick modification may be used.

Witness marks may provide a visual indication of whether the ink stick has been modified from a previous configuration to a different configuration. In particular, the incorporation of a simulation surface in an ink stick to change the configuration from a first configuration to a second configuration may cause a break or interruption of the continuity of the witness mark thereby providing a visual indication of the reconfiguration to an individual such as a manufacturer's representatives, maintenance personnel, distributors, sales persons, purchasers, and end users. A witness mark may be incorporated into the ink stick during or after the ink stick body, including insertion and/or feeding features, has been formed. Thus, simulation surfaces incorporated into the ink stick after the witness mark has been formed may overly at least a portion of the witness mark and interrupt the continuity of the witness mark.

FIG. 6 depicts the ink stick 100A of FIG. 5 including simulation surface 200B located in side 144 of the ink stick. As mentioned above, the simulation surface 200B includes a recess 168B' that is configured to simulate the recessed contour 168B of ink stick 100B of FIG. 5. As seen in FIG. 6, the continuity of the witness mark has been interrupted at location 180 by the incorporation of the simulation surface 200B into the ink stick. A visual inspection of the witness mark 160 by an individual allows a determination to be made whether the ink stick 100A has been modified from its manufactured configuration to simulate the manufactured configuration of ink stick 100B of FIG. 5. The witness mark 160, shown in FIG. 6 with somewhat square shoulders, may be of any size and configuration that is reasonable to fabricate.

Those skilled in the art will recognize that numerous modifications can be made to the specific implementations described above. For example, although the witness mark has been shown as being provided along the insertion perimeter of the ink stick, witness marks may be provided along the feed perimeter of the ink stick as an addition to or alternative to the insertion perimeter. Those skilled in the art will recognize that the witness mark may be formed in numerous shapes and configurations other than those illustrated. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A solid ink stick comprising:

an ink stick body formed of a phase change ink material, the ink stick body having a plurality of exterior surfaces arranged in a first ink stick body configuration, at least one of the exterior surfaces forming a key in the first ink stick body configuration; and a simulation surface added to the ink stick body, the simulation surface simulating a functionally significant surface of a second ink stick body configuration, the simulation surface enabling the ink stick body having the plurality of exterior surfaces arranged in the first ink stick body configuration to function in a solid ink printer as an ink stick having the second ink stick body configuration.

2. The solid ink stick of claim 1, the simulation surface including at least one recess of the second ink stick configuration.

3. The solid ink stick of claim 1, the simulation surface further including at least one protrusion of the second ink stick configuration.

4. The solid ink stick of claim 1, the simulation surface including a plurality of protrusions of the second ink stick configuration.

5. The solid ink stick of claim 1, the simulation surface being configured to adjust a shape of the ink stick body corresponding to the first ink stick body configuration to a shape corresponding to the second ink stick body configuration, the second configuration having a shape that is different than the shape of the first configuration.

6. The ink stick of claim 5, the shape of the first configuration being complementary to an opening in a first phase change ink imaging device, and the shape of the second configuration being complementary to an opening in a second phase change ink imaging device.

7. A method of modifying an ink stick, the method comprising:

identifying differences in exterior surface configurations between a first solid ink stick having an exterior surface with a first configuration that includes at least one key and a second solid ink stick having an exterior surface with a second configuration, the first configuration disables the first solid ink stick from being inserted through a keyed opening corresponding to the second configuration; and modifying the exterior surface of the first ink stick having the first configuration by either adding material to or removing material from the first solid ink stick to transform the first solid ink stick to a solid ink stick having the second configuration to enable the transformed first solid ink stick to be inserted through a keyed opening corresponding to the second configuration.

8. The method of claim 7, the key in the first configuration having a contour formed in a first position on the exterior surface of the first ink stick.

9. The method of claim 8, the modification of the exterior surface of the first ink stick further comprising:

altering the exterior surface of the first ink stick to include a second key contour at a second position different than the key contour at the first position to transform the exterior surface of the first ink stick to have the second configuration.

10. The method of claim 9, the alteration of the exterior surface further comprising:

removing phase change ink material from the exterior surface at the second position to form the second key contour at the second position.

11. The method of claim 9, the alteration of the exterior surface further comprising:

adding phase change ink material to the exterior surface at the second position to form the second key contour at the second position.

12. The method of claim 9, further comprising:

altering the exterior surface of the first ink stick to remove the key contour at the first position from the exterior surface of the first ink stick.

13. The method of claim 12, the alteration of the exterior surface to remove the key contour at the first position further comprising:

removing phase change ink material that forms the key contour at the first position from the exterior surface.

14. The method of claim 12, the alteration of the exterior surface to remove the key contour at the first position further comprising:

adding phase change ink material to a recess in the exterior surface at the first position.

15. The method of claim 7, the first solid ink stick having the exterior surface with the first configuration being for use with a first phase change ink imaging device, and the second solid ink stick having the exterior surface with the second configuration being for use with a second phase change ink imaging device.

* * * * *